United States Patent [19]

Tuji

[11] 4,125,059

[45] Nov. 14, 1978

[54] FLUID PRESSURE OPERABLE SERVO POSITIONER

[75] Inventor: Hirokazu Tuji, Kobe, Japan

[73] Assignee: The Nippon Air Brake Co., Ltd., Kobe, Japan

[21] Appl. No.: 759,445

[22] Filed: Jan. 14, 1977

[30] Foreign Application Priority Data

Apr. 5, 1976 [JP] Japan ..... 51-38442

[51] Int. Cl.[2] ..... F01B 7/20

[52] U.S. Cl. ..... 92/51; 92/63; 92/65; 92/129; 92/151

[58] Field of Search ..... 92/62, 63, 65, 138, 92/150, 151, 51, 129; 91/169, 173

[56] References Cited

U.S. PATENT DOCUMENTS

| | | | |
|---|---|---|---|
| 2,671,431 | 3/1954 | Zumbusch | 92/51 |
| 2,831,464 | 4/1958 | Lillquist | 92/62 |
| 3,152,520 | 10/1964 | Heese | 92/62 |
| 3,791,230 | 2/1974 | Webb | 92/65 |
| 4,002,105 | 1/1977 | Bell | 92/62 |

FOREIGN PATENT DOCUMENTS

| | | | |
|---|---|---|---|
| 1,198,151 | 6/1958 | France | 92/62 |
| 939,035 | 10/1963 | United Kingdom | 92/62 |

*Primary Examiner*—Martin P. Schwadron
*Assistant Examiner*—Abraham Hershkovitz
*Attorney, Agent, or Firm*—R. S. Visk; R. W. McIntire, Jr.

[57] ABSTRACT

A fluid pressure operable servo positioner including a pair of operating piston units diametrally opposingly arranged relative to and abuttingly engageable with opposite sides of a mechanical operating member or lever for positioning the operating member in a preselected position determined by the degree of actuating pressure acting on the piston or pistons which are retractable by return springs, when relieved of actuating pressure acting thereon, completely out of contact with the operating member to an extent at which the operating member may be manually positioned, within a full range of positions, free of any resistance such as piston friction.

2 Claims, 5 Drawing Figures

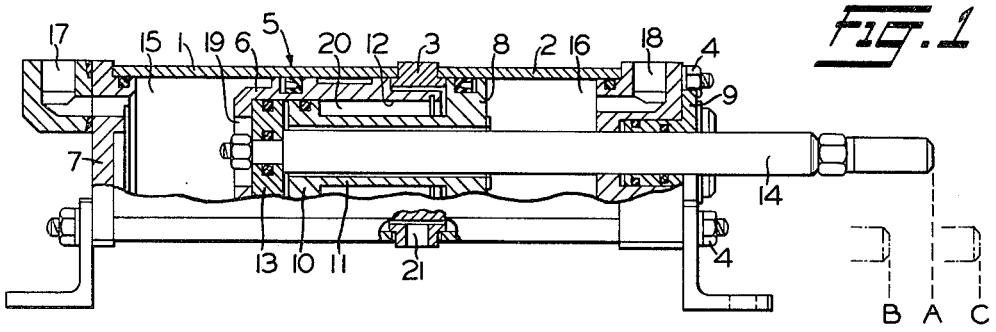
FIG. 1
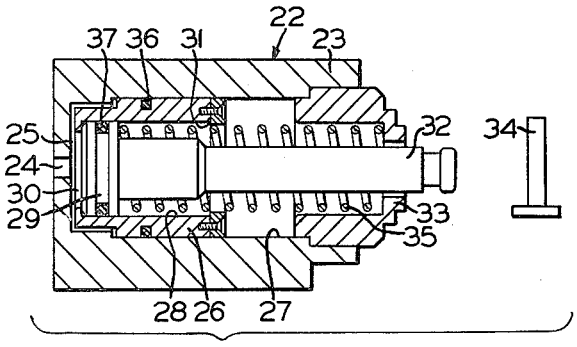
FIG. 2
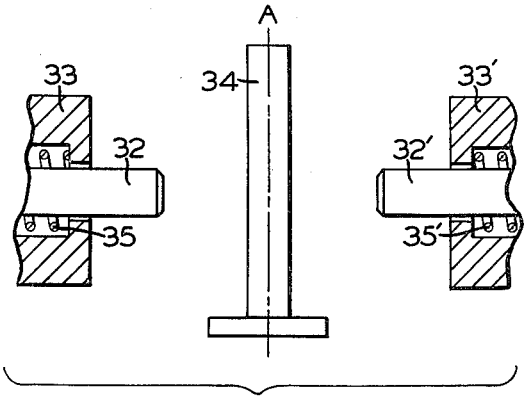
FIG. 5
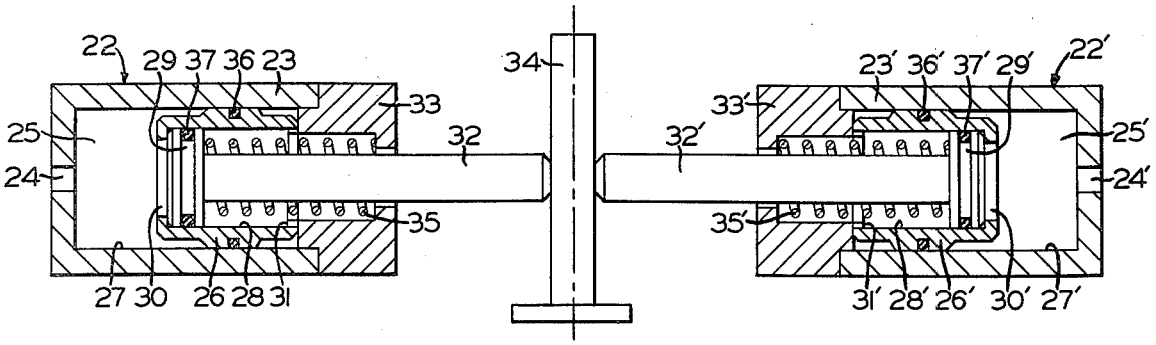
FIG. 3
FIG. 4
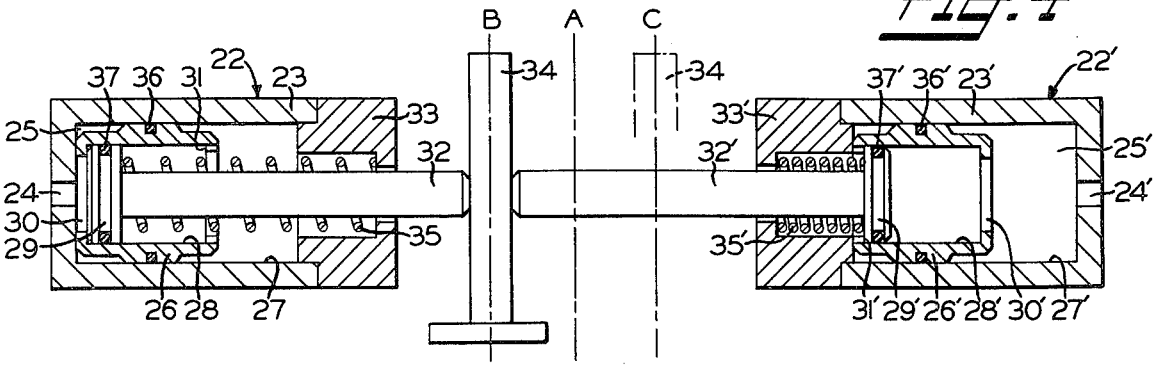

FLUID PRESSURE OPERABLE SERVO POSITIONER

BACKGROUND OF THE INVENTION

Servo positioners are generally used for positioning a mechanical member such as a shift lever, for example, for shifting the clutch mechanism of a marine vessel between the several positions, namely, neutral, forward, or reverse. When a fluid pressure, piston-operated positioner device is employed for this purpose, there is a possibility of fluid pressure failure, in which event it becomes necessary to operate the shift lever manually. Manual operation of the shift lever may be difficult due to frictional resistance or dash pot action of the piston or pistons of the positioner device. In order to permit shifting under these adverse conditions, it may be necessary to provide special mechanism for releasing the connection between the positioner device and the shift lever.

SUMMARY OF THE INVENTION

The object of the present invention is to provide a fluid pressure operable servo positioner device structured such as to be completely disengaged from the member or lever positionable thereby, when the positioner device is relieved of operating pressure or in the event of failure of such operating pressure, so that said member or lever may be manually positioned within the entire range of positions freely of any resistance from the immobilized pistons of the positioner device.

The invention comprises a fluid pressure operable servo positioner including either a single piston or opposingly arranged double pistons for applying a positioning force, through a piston rod or rods, respectively, to a mechanical member or lever for positioning said lever in a preselected position determined by the degree of actuating fluid pressure acting on the piston or pistons, said pistons and piston rods being retractable by return springs away from said mechanical lever for relieving the lever of said positioning force upon release of said actuating pressure acting on the piston or pistons. In accordance with the invention, the piston rod or rods acting on the mechanical lever are arranged such that when retracted by the return spring or springs to a fully retracted position, the mechanical lever is completely out of contact with the piston rod or rods and may, therefore, be manually positioned within a full range of positions without the effect of resistance from piston friction.

BRIEF DESCRIPTION OF THE DRAWING

FIG. 1 is an elevational view, in section, of a conventional fluid pressure operable servo positioner.

FIG. 2 is an elevational view, in section, of a single piston servo positioner embodying the invention.

FIG. 3 is an elevational view, in section of an opposed double piston servo positioner embodying the invention and shown in a neutral position.

FIG. 4 is an elevational view, in section, of the servo positioner shown in FIG. 3 but in a different position.

FIG. 5 is a fragmentary view, in outline, showing the servo positioner in still a further position.

PRIOR ART

A presently known servo positioner device is shown in FIG. 1, wherein left and right cylindrical end portions 1 and 2, respectively, are secured in axial alignment by an intermediate annular member 3 and a plurality of bolts 4 to form a cylindrical casing 5. A first piston 6 is reciprocably disposed in left end portion 1 between annular member 3 and a closure member 7 sealingly secured at the outer end of said left end portion, while a second piston 8 is reciprocably disposed in right end portion 2 between said annular member and a closure member 9 sealingly secured at the outer end of said right end portion.

A third piston 10, integrally connected to second piston 8 by a tubular coaxial stem 11, is reciprocably coaxially operable within a bore 12 extending through first piston 6. A fourth piston 13 is reciprocably coaxially disposed in bore 12 between first piston 6 and third piston 10, said fourth piston being fixedly attached to and in axial alignment with a force applying shaft 14 extending coaxially through hollow stem 11, cylindrical right end portion 2, closure member 9, and connected to a operating member (not shown) for controlling operation of a devcie (not shown) such as a clutch for a marine vessel, for example.

Fluid pressure may be supplied at substantially the same pressure to chambers 15 and 16 via respective inlet-outlet ports 17 and 18, whereby first piston 6 and second piston 8 are moved in respective opposite directions and stop at a neutral position in which they are shown in FIG. 1 and at which the operating member (not shown) connected to force-applying shaft 14 occupies a corresponding neutral position designated A in the drawing. If, for example, fluid pressure in chamber 16 is exhausted, fluid pressure prevailing in chamber 15 may flow via an opening 19 formed in the adjacent end of first piston 6 to act on and cause rightward movement of fourth piston 13, which thereby causes corresponding movement of third and second pistons 10 and 8, so that force-applying shaft 14 is also moved to the right, thus moving the operating member to position C. In contradiction to the aforesaid case, if fluid pressure is exhausted from chamber 15, force-applying shaft 14 is moved leftwardly and the operating member is corresponding moved to left-hand position B. An annular chamber 20 formed cooperatively by and between bore 12 and the outer surface of tubular stem 11, is open to atmosphere via a port 21 formed in annular member 3 to permit uninhibited relative movement between the several pistons as effected by fluid pressure supplied to or exhausted from chambers 15 and 16, as above described.

The above-described servo positioner, as shown in FIG. 1, may be used, for example, to operate changeover mechanism for setting the clutch of a marine vessel into neutral, forward, or reverse positions. Such position setting may be effected by operation of a clutch lever (not shown and corresponding to the above-mentioned operating member) of a control device located on the bridge or may be operated by use of separate means. In this case, with the above-described conventional servo positioner device, if fluid pressure in both chambers 15 and 16 is completely exhausted and notwithstanding that the operating member connected to force-applying shaft 14 is free, manual operation of said operating member is difficult, since frictional resistance of the several pistons 6, 8, 10, and 13 must be overridden. For this reason, during manual operation, the operating member must be disconnected from force-applying shaft 14 for which a special connecting-disconnecting mechanism is required.

With the present invention, there is no necessity for having the operating member connected to force-applying shaft 14 and, therefore, no necessity for a connecting-disconnecting mechanism as is required in the case of the conventional positioner above described.

DESCRIPTION AND OPERATION OF PRESENT INVENTION

A practical example of a servo positioner device according to the present invention will now be described with reference to FIGS. 2, 3, 4, and 5.

FIG. 2 illustrates an operating piston unit 22 for a servo positioner device, which will be more fully described hereinafter, with numeral 23 indicating a cylindrical casing at one end of which is provided a supply-exhaust port 24 via which fluid pressure may be supplied to and exhausted from a pressure chamber 25 formed in said casing adjacent the lefthand end thereof.

A large-diameter or primary piston 26 is reciprocably disposed in a coaxial bore 27 formed in casing 23 and cooperates with said piston and said casing to form chamber 25. Within a bore 28 formed coaxially in primary piston 26, a small-diameter or secondary piston 29 is telescopically reciprocably operable. At the end of primary piston 26 adjacent chamber 25, a concentric opening 30 is provided, while an internal annular shoulder 31 formed at the other end of said primary piston acts as a stop for limiting rightward movement of secondary piston 29 therein.

A force-applying shaft 32, fixedly attached to and in axial alignment with secondary piston 29, extends coaxially through and terminates exteriorly of a closure member or end cap 33 secured at the right-hand end of casing 23. Force-applying shaft 32 may be extended rightwardly out of casing 23 by fluid pressure acting on secondary piston 29, to an extended position in abutting contact with an operating member 34 for operating a device not shown. A spring 35, compressed between end cap 33 and secondary piston 29 serves to bias pistons 26 and 29 leftwardly, as viewed in FIG. 2, against the end wall of casing 23. O-rings 36 and 37 are disposed in pistons 26 and 29, respectively, for providing sealing relation between the pistons and the respective surfaces of bores 27 and 28.

FIG. 3 shows the complete assembly of a servo positioner device employing a pair of operating piston units 22 and 22', as shown in FIG. 2, diametrally opposingly arranged on opposite sides of operating member 34. Since operating units 22 and 22' shown in FIG. 3 are identical in structure to unit 22 shown in FIG. 2, similar reference numerals have been applied to the several corresponding parts, except those of the rightside unit 22' which are further designated as prime (').

When fluid pressure is supplied at equal pressures to operating units 22 and 22' via supply-exhaust ports 24 and 24' to chamber 25 and 25', respectively, such fluid pressure acts on piston pairs 26–29 and 26'–29' to cause rightward and left-ward movement against the opposing forces of springs 35 and 35', respectively. As a result, primary pistons 26 and 26' move to the right and left in unison with secondary pistons 29 and 29', respectively, until such movement is terminated by abutment of said primary pistons with end caps 33 and 33', respectively, which coincides with abutting engagement of shafts 32 and 32 with opposite sides of operating member 34. When this happens, operating member 34 is acted upon from the right and left by the force-applying shafts 32 and 32' and is stopped in neutral position A. This neutral position A is accurately maintained by opposing forces from the action of secondary pistons 29 and 29', which, it should be noted in this situation occupy respective positions adjacent the rear ends or openings 30 and 31' of primary pistons 26 and 26'.

Next, referring to FIG. 4, when fluid pressure in chamber 30 of the operating unit 22, for example, is exhausted, operating member 34 is acted upon by a pushing force exerted thereon by secondary piston 29' of operating unit 22' which may now move to its extreme leftward limit in engagement with shoulder 31'. Furthermore, pistons 26 and 29 of operating unit 22 are urged to move leftwardly by pressure acting on piston 29' and the force of return spring 35. Piston 26, on reaching and abutting against the left-hand end wall of casing 23, is stopped. During this time, operating member 34 is moved toward the left and stops at position B.

On the other hand, if fluid in chamber 25' of operating unit 22' is evacuated, operating member 34 is subjected to the effect of pressure acting on piston 29 of operating unit 22 and is accordingly moved toward the right and stops at position C.

When fluid pressure is exhausted from both chambers 25 and 25' of operating units 22 and 22', respectively, the piston pairs 26–29 and 26'–29' are moved respectively to the left and right due to the forces of return springs 35 and 35', and as a result, force-applying shafts 32 and 32' are moved to respective retracted positions in which they are completely out of contact with operating member 34, as shown in FIG. 5, thus making manual operation of said operating member by a separate system more feasible.

In the above-mentioned practical example, when the pistons 26 and 26' of the two operating units 22 and 22' move against end caps 33 and 33', that is, with shafts 32 and 32' in their respective retracted positions, operating member 34 assumes its neutral position A, thus easily affording setting in the neutral position without the provision of a special mechanism. Furthermore, although only three positions A, B and C have been mentioned, the positioner device embodying the invention is not limited to said three positions only, but may be set to any number of positions between A and B and between A and C in accordance with the relative degrees of fluid pressure supplied to chambers 25 and 25'.

As described hereinbefore, the present invention is of simple design and no mechanism for releasing the connection between shafts 32 and 32' and operating member 34 is necessary, because such connection with the operating member is effected automatically, and operation of the operating member by means of a separate system is made easily possible. Hence, when applied to the change-over mechanism of the clutch of a boat or the like, there is the advantage that operation can be carried out from the bridge or just as easily as from another location.

Having now described the invention, what I claim as new and desire to secure by Letters Patent, is:

1. A fluid pressure operable servo positioner device for selectively positioning an operating member in one of a plurality of control positions within a range of positions having opposite limits, said servo positioner device comprising a pair of operating units diametrally opposingly arranged on opposite sides of the operating member and each including piston means independently subjectable to fluid pressure and movable in one direction responsively thereto toward respective extended positions in abutting contact with said opposite sides of the operating member for positioning the operating member in one of said plurality of positions according to the relative fluid pressures acting on the respective piston means, (a) said piston means being operable:

(i) when both are subjected to respective equal fluid pressures, to said extended positions for engaging and maintaining the operating member in a central neutral position, (ii) when each is subjected to respective different fluid pressures, to said extended positions for engaging and maintaining the operating member in a preselected position, on one side or the other of said neutral position, according to the relative degree of said different pressures, (iii) or when both are relieved of all fluid pressure, to respective retracted positions out of contact with said operating member which may be manually operated to any one of said plurality of positions free of contact with the piston means, (b) said operating units each including a cylindrical casing for the respective piston means, (c) each of said piston means comprising:

(i) a primary piston reciprocably operable in said casing between first axial limits;

(ii) a secondary piston coaxially telescopically operable within said primary piston between second axial limits greater than said first axial limits; and (iii) respective spring means for biasing said primary and secondary pistons toward said retracted positions; and (d) each of said cylindrical casings having a pressure chamber formed therein adjacent said piston means and chargeable with fluid pressure at respective preselected degrees, each of said primary pistons being provided with a concentric opening at one end adjacent said pressure chamber via which opening fluid pressure may flow from said pressure chamber to act on the respective secondary pistons and each of said primary pistons has an annular internal shoulder formed at the other end opposite said one end for limiting said axial travel of said secondary piston in said one direction.

2. A fluid pressure operable servo positioner device, as set forth in claim 1, wherein said piston means each further include a force-applying shaft secured to said secondary piston in axial alignment therewith and extending therefrom toward said operating member for making said abutting contact with the respective side of the operating member.

* * * * *